US005505576A

United States Patent [19]

Sizemore et al.

[11] Patent Number: 5,505,576

[45] Date of Patent: Apr. 9, 1996

[54] SIDE LOADER FOR CURBSIDE REFUSE CONTAINER

[75] Inventors: Raymond C. Sizemore, Claremore; Nathan T. Kemmerly, Tulsa; David A. Schmigle, Broken Arrow, all of Okla.

[73] Assignee: Crane Carrier Company, Tulsa, Okla.

[21] Appl. No.: 401,971

[22] Filed: Mar. 9, 1995

[51] Int. Cl.[6] ..... B65F 3/04

[52] U.S. Cl. ..... 414/409; 414/718; 414/595; 414/540; 414/422; 414/631; 414/408; 414/728

[58] Field of Search ..... 414/403, 404, 414/406, 407, 408, 409, 410, 419, 619, 420, 421, 733, 422, 540, 544, 546, 555, 618, 617, 595, 128, 630, 631, 634, 635, 918, 718; 254/98, 100

[56] References Cited

U.S. PATENT DOCUMENTS

| | | | |
|---|---|---|---|
| Re. 34,292 | 6/1993 | Bingman et al. . | |
| 1,763,499 | 6/1930 | Bolger | 414/409 |
| 3,910,434 | 10/1975 | Ebeling et al. . | |
| 3,944,092 | 3/1976 | Ebeling et al. . | |
| 4,005,791 | 2/1977 | Stragier et al. . | |
| 4,057,156 | 11/1977 | Thompson et al. . | |
| 4,219,298 | 8/1980 | Stragier et al. | 414/409 |
| 4,313,707 | 2/1982 | Bingman et al. . | |
| 4,427,333 | 1/1984 | Ebeling . | |
| 4,597,710 | 7/1986 | Kovats | 414/409 |
| 4,917,796 | 4/1990 | Rudzinski | 414/422 X |
| 5,092,731 | 3/1992 | Jones et al. . | |

FOREIGN PATENT DOCUMENTS

| | | | |
|---|---|---|---|
| 1189748 | 11/1985 | U.S.S.R. | 414/408 |
| 1569286 | 6/1990 | U.S.S.R. | 414/409 |
| 2080757 | 2/1982 | United Kingdom | 414/408 |

*Primary Examiner*—Frank E. Werner
*Attorney, Agent, or Firm*—Head & Johnson

[57] ABSTRACT

A side loader for picking up curbside refuse containers includes a hydraulic telescopic boom located adjacent a top open refuse compartment of a vehicle. The boom is adapted for inward/outward movement transverse to the forward/rearward axis of the vehicle. A mast is connected via a hydraulic powered helical rotary actuator for pivotal movement of its lower end inward and outward. A similar rotary actuator is used to operate the grabber arm assembly.

6 Claims, 14 Drawing Sheets

*Fig. 7*
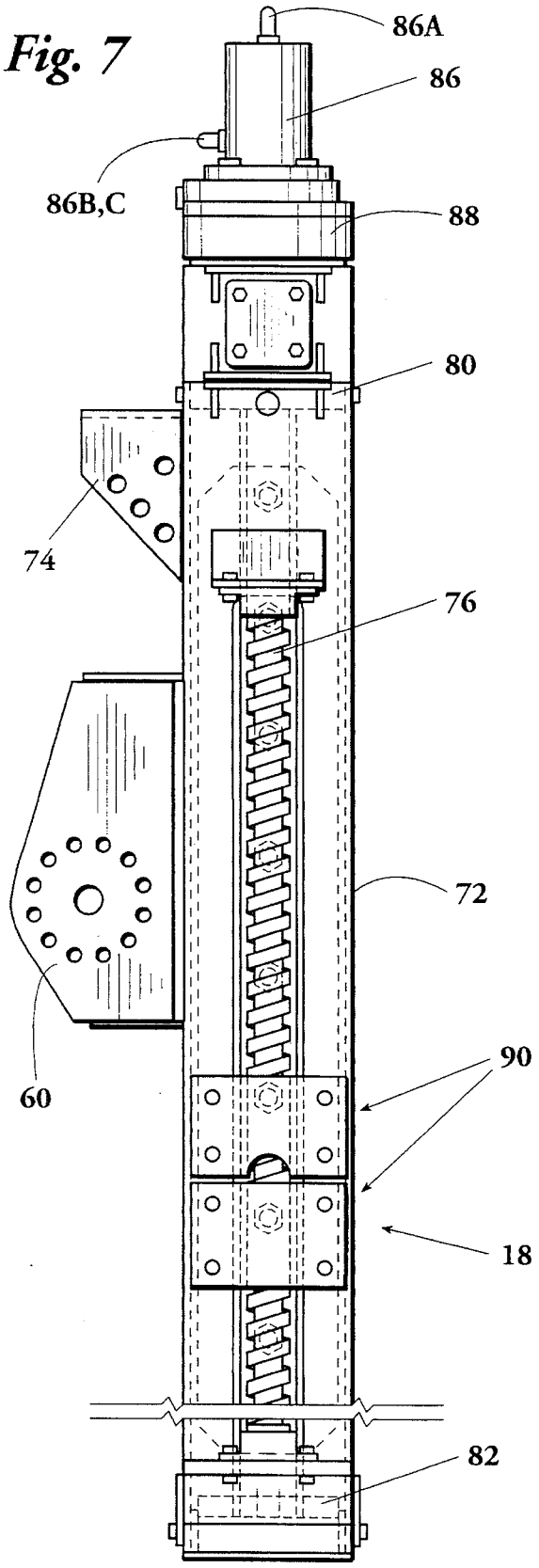
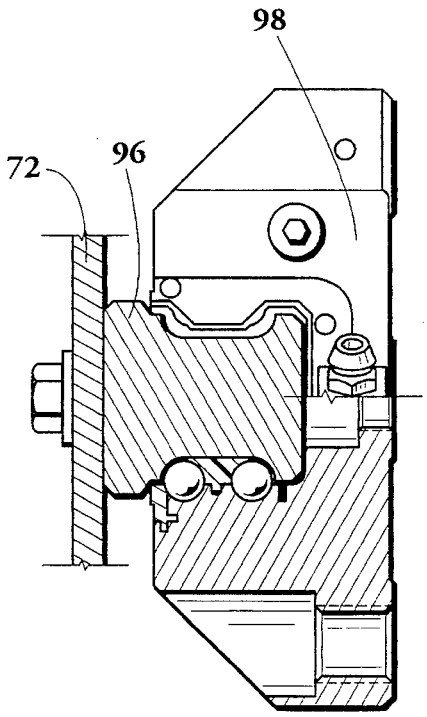
*Fig. 9*

254
JOYSTICK AIR VALVE
202
200
EXT
UP
RET
ON
250
252
DUMP
IN
OUT
PACK BLADE
EXT
RET
TAILGATE
RAISE
LOWER
LATCH
LOCK
UNLOCK
244
246
"EXTEND" AND "RETRACT" SEQUENCING
SELF LEVEL "UP"
232
SELF LEVEL "DOWN"
230
SELF-LEVELING CONTROL
LIFT "LOWER" ROTATE "OUT"
226
LIFT "RAISE" ROTATE "IN"
224
SEQUENCING AND GRABBER CONTROL
GRABBER "CLOSE"
220
GRABBER "OPEN"
218
"BOOM IN" /"KICKIN"
210
"KICKOUT"/ "BOOM OUT"
212

SIDE LOADER FOR CURBSIDE REFUSE CONTAINER

BACKGROUND OF THE INVENTION

This invention is related to the field of refuse collection, and more specifically, directed to the collection of refuse from a curbside location by a single-person refuse collection vehicle.

Many communities have now instigated trash collection procedure wherein the residents are required to place standardized refuse containers at the curbside. As such, a need arises to provide a mobile refuse collection vehicle that is capable of grasping, elevating, and dumping the containers into the vehicle and then returning the empty container to the curbside location, all of which can be done while the vehicle operator remains in the driving position. Once the refuse vehicle is loaded, it is taken to a dump, landfill or recycling center. The collection process may be complicated by the placement of the refuse container relative to the curbside, the accessabilty from the street, and the ability to accomplish the collection process in a relatively limited space. For example, making pick-ups between parked vehicles, trees, in narrow alleys or other objects which would ordinarily inhibit the side loading process.

A variety of mechanisms have been proposed for efficiently emptying trash containers into a collection vehicle; and as such, the previous designs have resorted to innumerable mechanical arrangements. Apparatus have been disclosed wherein trash containers are lifted from the ground and dumped into collection vehicles or into a collection vehicle with lifting mechanisms that have raised the trash container over the side, the front, or back of the vehicle. Many of these mechanisms have used complex mechanical chains, sprockets, cams, cables and hydraulic power cylinder/piston lifts to accomplish the curbside collection process. Some even require additional personnel to assist in seeing that the container is loaded and unloaded correctly at the curbside. A great majority of the prior inward/outward mechanisms operate by power supplied from the under carriage of the refuse receiving vehicle to a vertical mast and are thus susceptible to road hazards and damage.

Exemplary of such prior art disclosures are those found in the following United states patents:

| | |
|---|---|
| 4,313,707 | 3,910,434 |
| 4,057,156 | 4,427,333 |
| RE 34,292 | 5,092,731 |
| 4,005,791 | 3,944,092 |

Other limitations and safeguards must be considered in the operation of a refuse collection vehicle of this type when considering its various phases of highway travel, curbside collection, compaction, and dumping of the compacted refuse.

SUMMARY OF THE INVENTION

Accordingly, there is an object of this invention to provide a curbside refuse collection vehicle that is capable of extending from the side of the vehicle outwardly to any of a variety of lengths, grab a refuse container, raise, lift and dump same in an upper side opening of the vehicle.

It is a further object of this invention to provide a side loading refuse collection vehicle that is capable of manipulation by a single vehicle driver/operator from the vehicle cab, preferably, the curbside or passenger side.

It is a further object of the invention to provide a curbside refuse side loading vehicle that is capable of collecting refuse container from limited curbside space, direct the container upward, dump its contents into the vehicle body, and move the empty container, downward and outwardly to the position it originally occupied while returning the side loading device to the vehicle.

An important object of the invention is to provide a mast for lifting and dumping a refuse container that is of minimal width to permit extend/retract movement within limited curbside space, yet is structurally sturdy to accomplish lifting, dumping and returning refuse collection containers to and from curbside locations.

A yet further object of the invention is to provide a side loading curbside refuse collection that is operated substantially hydraulically using electric and pneumatic controls and otherwise, is simple in construction with a minimum of operating parts to accomplish the desired results.

Specifically, the invention is directed to a side loader for refuse containers having a principle support boom situated in the upper part of the vehicle adjacent a refuse collection and receiving opening in the vehicle. The boom is telescopically supported and horizontally extensible within a vertical plane that is transverse or lateral to the forward/rearward axis of the vehicle. Connected to the outer end of the telescopic support boom, is a mast pivotally connected for 'kick in' and 'kick out' movement also within the same vertical plane. The mast includes a rotatable threaded shaft of a recirculating ball screw type along its length and a carriage assembly that is retained within the mast by a linear guide rail system for vertical movement. A hydraulic motor causes rotation of the threaded shaft. The carriage assembly is connected to the shaft utilizing a ball nut wherein rotation of the shaft will cause the carriage to travel upwardly and downwardly from the upper end to the lower end of the mast. A hydraulic rotary actuator is adapted to cause the pivotal motion of the mast. As a result, thrust and radial forces are controlled to provide smooth and stable operation of the refuse container carriage assembly during the lift, dump and return sequences of operation. A cable and hose carrier system is utilized to support the various hydraulic power lines to the mast which maintains a relative rigid conduit during the inward and outward movement of the principle support boom and the pivotally connected mast, yet, the extension being flexible as the boom is retracted back into the upper part of the vehicle. A grabber arm assembly is pivotally attached to the carriage assembly and operated by another hydraulic rotary actuator. The grabber arm assembly includes pivotal arms that will grasp and/or release a curbside refuse container. The rotary actuator, which pivotally actuates the carriage assembly, can be automatically controlled to maintain the refuse container in a substantially upright or self-leveling position no matter what angular position of the mast.

A variable speed (V.S.) engine control mode is provided to limit operations to a given maximum engine rpm, e.g., 1400. This mode will engage only if (1) the power take-off (P.T.O.) is "on", (2) the right hand (curbside) brake treadle is depressed, and (3) the vehicle transmission is in "neutral". When the V.S. mode is engaged, this provides the operator with substantially constant hydraulic pump output and greater flexibility and speeds during the refuse packer blade auto sweep, manual sweep and during the refuse container collection, lift, dump and return cycles. Other safeguards within the V.S. mode include a dual set point electronic speed switch that performs two tasks: (1) inhibiting shifting from "neutral" to "drive" at a preset engine rpm, e.g. 900; and (2) disengaging the hydraulic pumps above 1600 rpm.

BRIEF DESCRIPTION OF THE DRAWINGS

FIG. 7 is a side elevational view, looking forwardly of the mast of the invention taken along the line of 7—7 of FIG. 6.

FIG. 9 is a sectional view taken along the line 9—9 of FIG. 8.

DETAILED DESCRIPTION OF THE PREFERRED EMBODIMENT

While the invention has been described with a certain degree of particularity, it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

Figure 1:
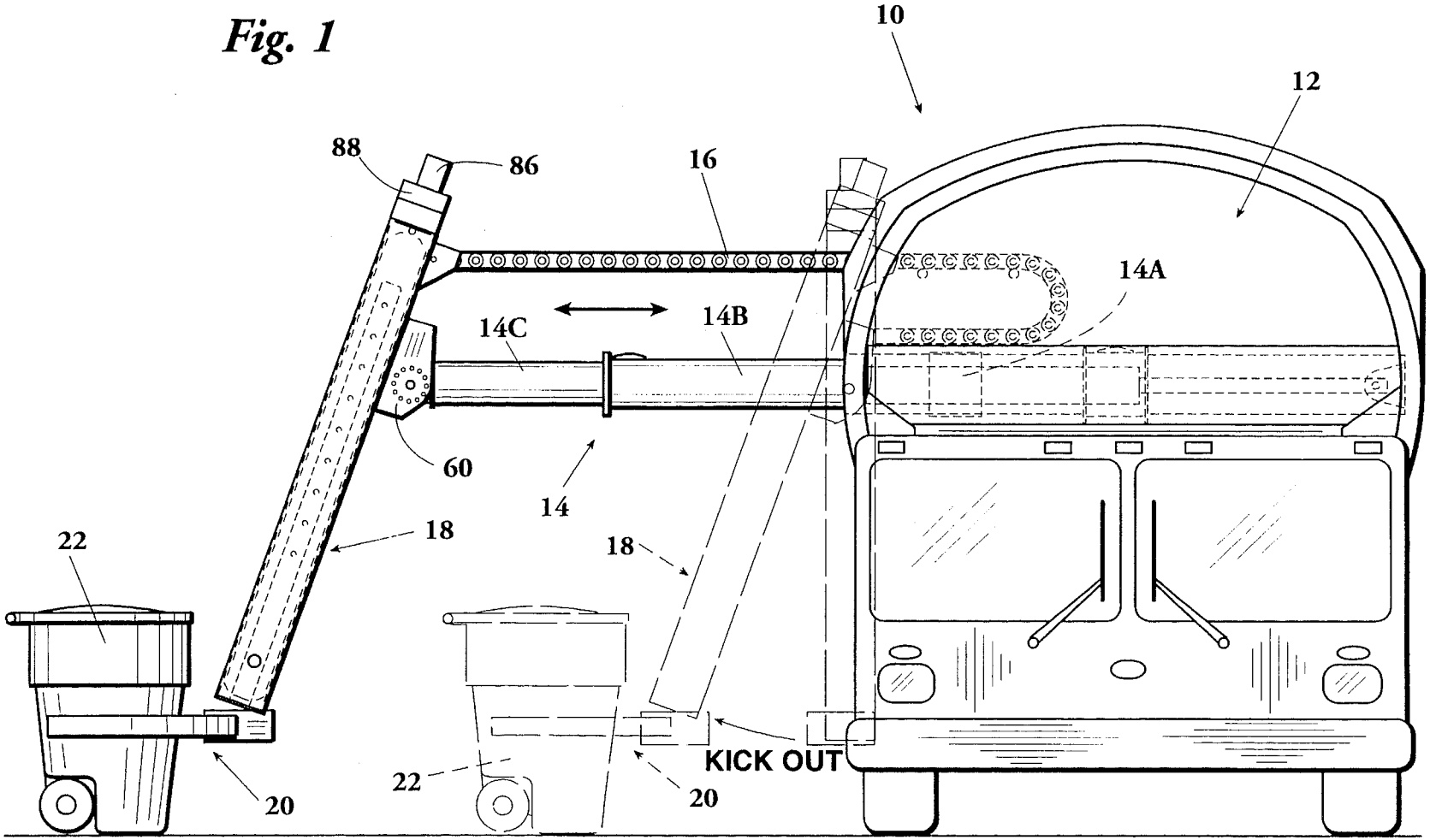
FIGS. 1–3 are front elevational views depicting the refuse container pick-up sequences.
Figure 2:
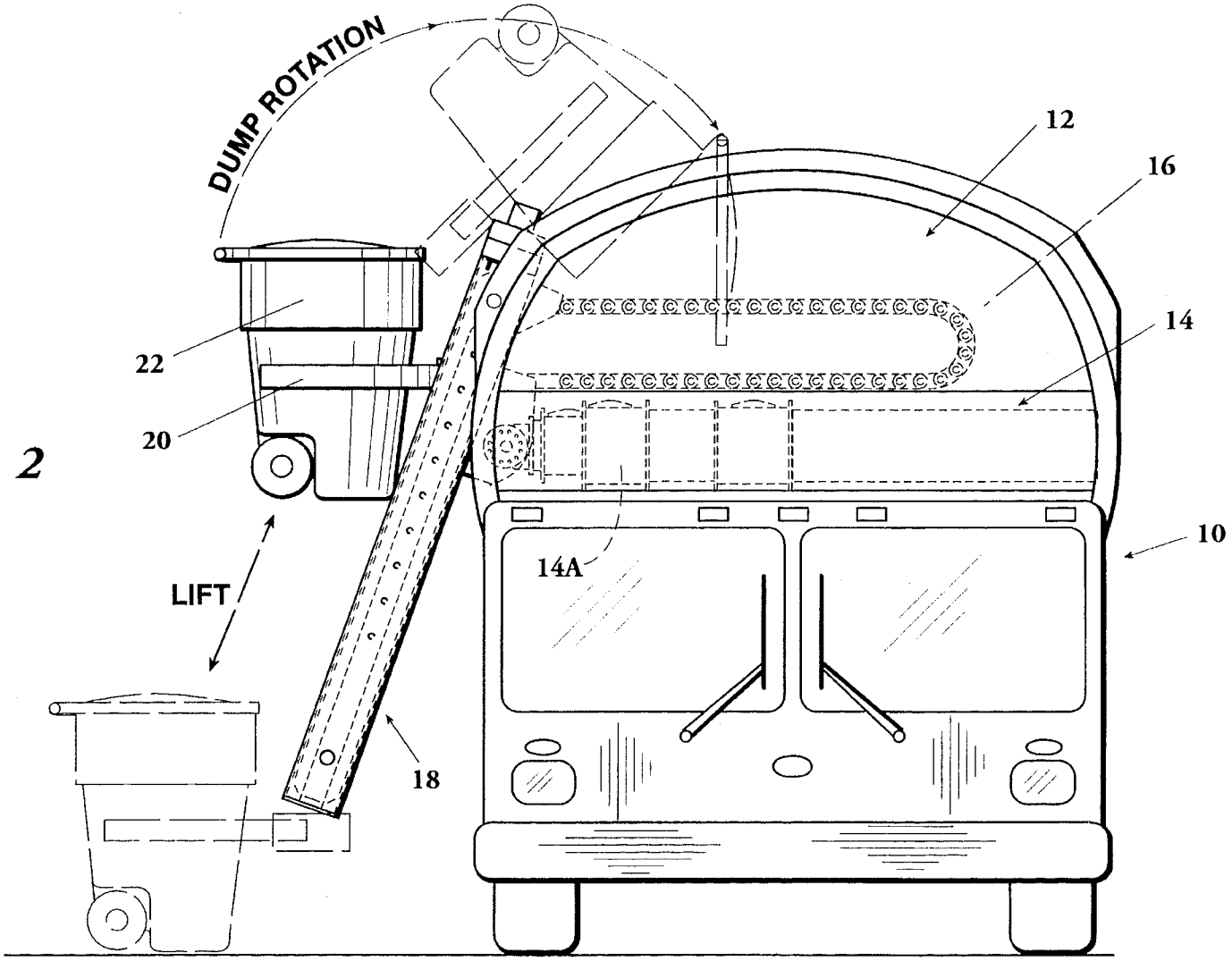
Figure 3:
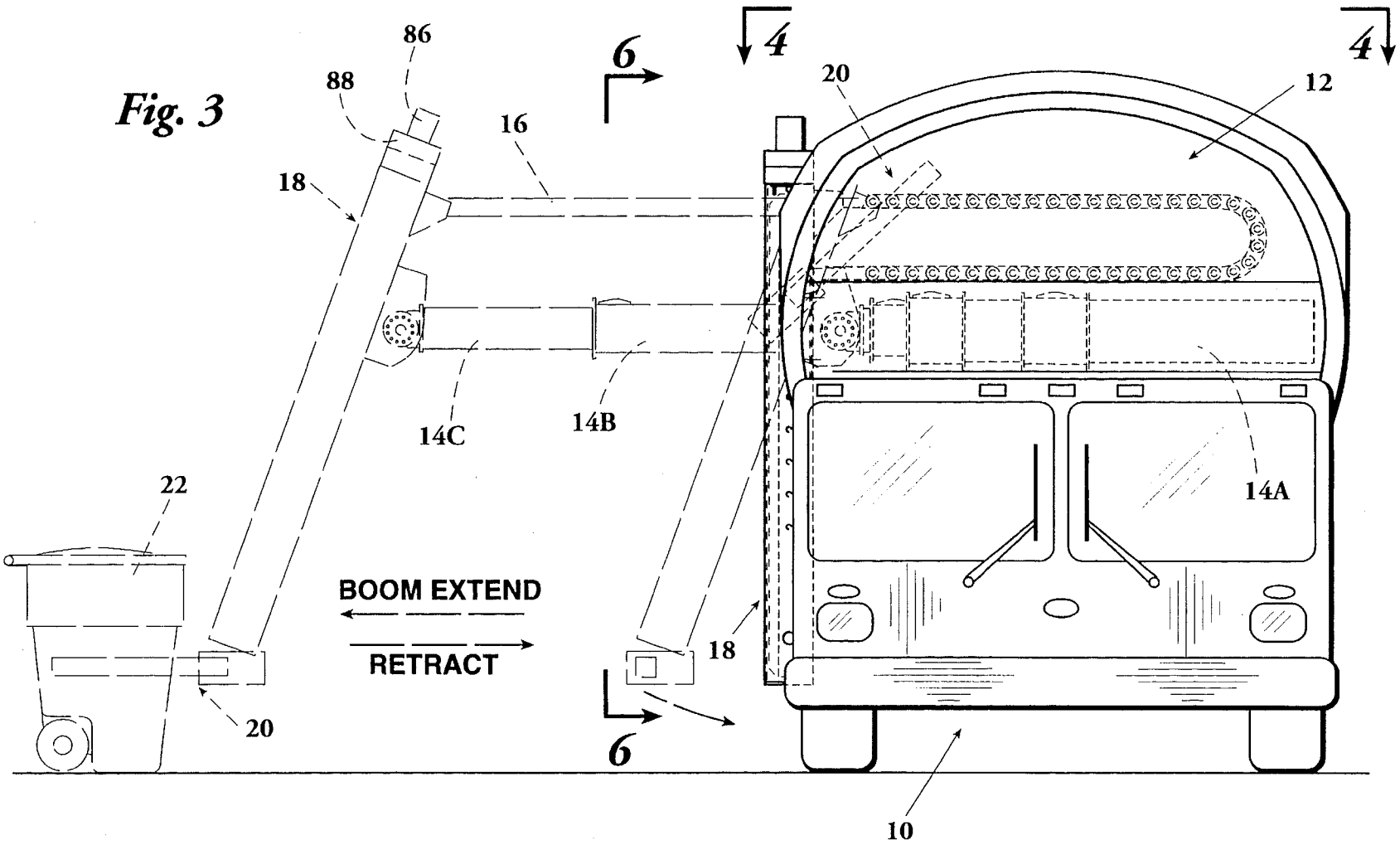

Referring to FIGS. 1–3, the side loader is connected to a vehicle, generally designated by the numeral 10, with the side loading apparatus adapted to extend, engage, retract and dump curbside refuse containers into a top opening of the body of the vehicle, generally designated by the numeral 12, followed thereafter by returning and releasing the refuse container in substantially the same curbside location where the pick-up occurred. The basic parts of the apparatus comprise a telescopic extensible boom generally indicated by the numeral 14 comprised of sections 14A, 14B, and 14C. A flexible extension 16 is used to support and carry hydraulic or other fluid power conduits from the power sources within the vehicle, not shown, to the operative structures of the side loader apparatus including the mast, generally designated as 18, and the curbside grabber assembly, generally designated by the numeral 20, for grasping and releasing a curbside refuse container 22. The flexible extension is of a chain link system capable of maintaining a relatively rigid condition as shown in FIG. 1 to carry and protect hydraulic or other fluid or electrical conduits; yet when retracted back into the upper part of the vehicle will have flexibility to be nested therein. Such a system is that sold by A & A Manufacturing Co., Inc. under the mark GORTRAC®.

The collection system operation and sequencing comprises boom 14 to be extended from a nested position, as in FIG. 1, to a retracted position as shown dotted in FIG. 2. Mast 18 during travel is nested vertically within the vehicle body as shown in FIGS. 1 and 3. The mast 18 is constructed for pivotal movement of the lower end about boom 14 between a "kick out" position as shown in FIG. 1 and a "kick in" usually travel position as shown in FIG. 3. Grabber 20 when in the nested and stowed travel position as shown dotted in FIG. 3, is usually closed, but operative to an open position (FIG. 11) prior to grasping the refuse container 22 as shown in FIGS. 1–3. The mast 18 also includes means to lift, raise, dump in, dump out and lower the grasped container. Sequential actuation of the loader system, i.e., the boom 14, mast 18 and grabber assembly 20 is preferably by an electric/pneumatic/hydraulic power logic system, the hydraulic power being created from an engine driven power take-off (P.T.O.).

In addition to the basic system, and as hereinafter described, a control system is utilized to achieve self-levelling of the grabber assembly 20 during the lift and lower operations, except during the dump "in" and dump "out" sequences, in order to maintain the refuse container substantially upright and prevent accidental spillage. The self-levelling system has an enable switch to turn the system "on". In the event that the self-levelling becomes disabled, the apparatus can continue to function with the use of manual controls as described herein. As hereinafter described, all of the automated and manual controls are mounted in the cab within reach of the operator/driver who normally will control the vehicle and the side loading system from the right hand side, or curbside, of the vehicle 10.

Figure 4:
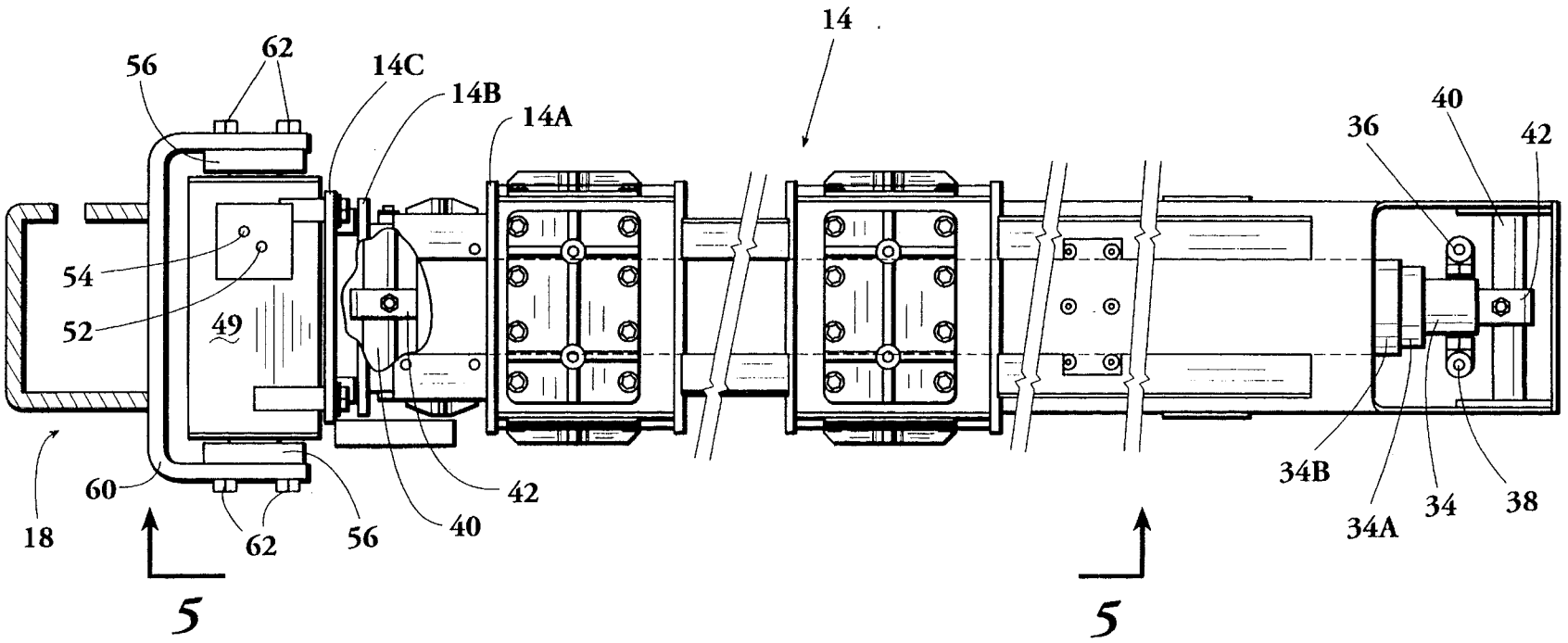
FIG. 4 is a top elevational view of the telescopic extensible boom.
Figure 5:
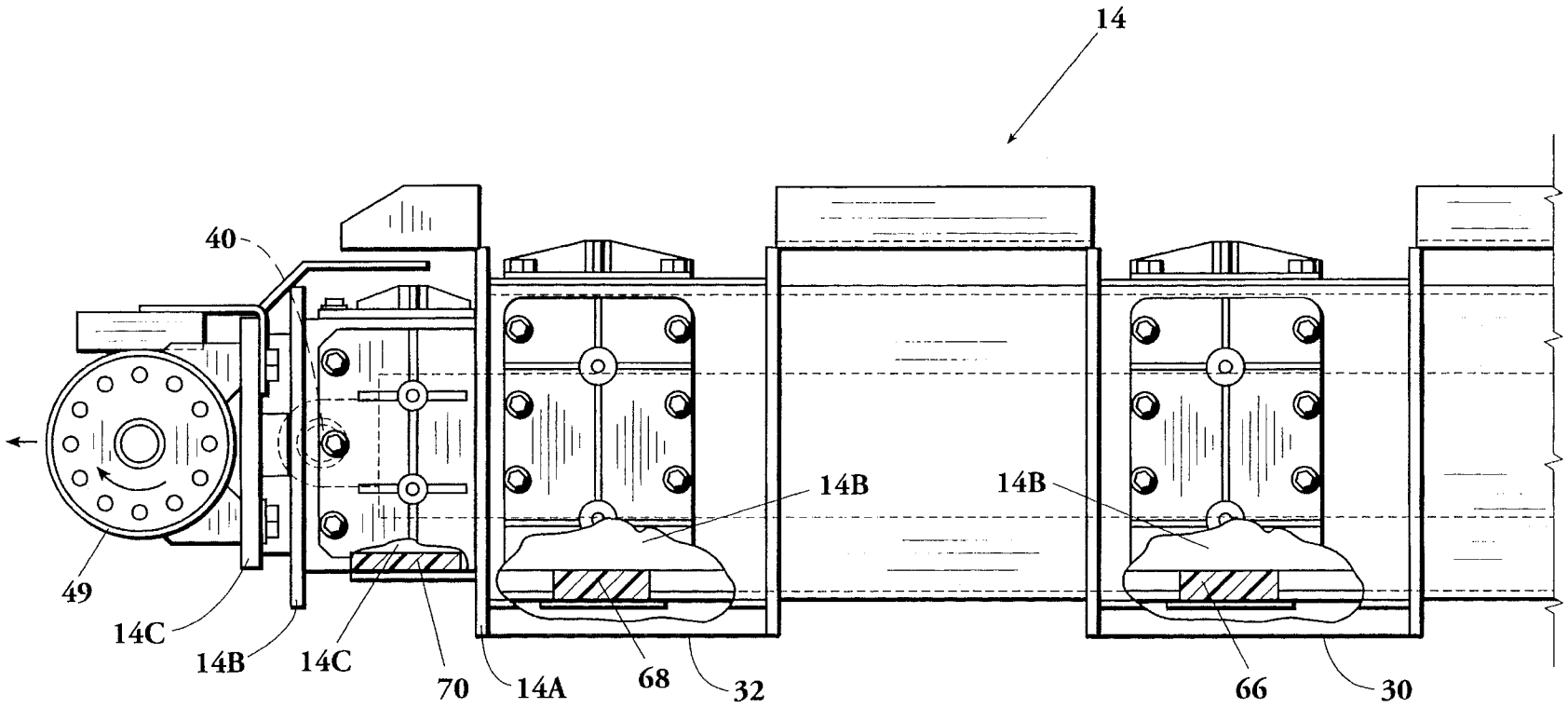
FIG. 5 is a partial elevational and sectional view taken along the line 5—5 of FIG. 4.

Referring now to FIG. 4, the extensible boom 14 is shown in a top view, while FIG. 5 is a partial front view. The boom is attached to the vehicle body by attachment plates 30 and 32. A hydraulic power cylinder and piston arrangement 34, with hydraulic connections 36 and 38 control the boom telescoping functions. The hydraulic cylinder is connected to the boom 14 by cylinder end lugs 42 using a pin arrangement 40. The hydraulic power cylinder used is of a double-acting two-stage type and includes sections 34A and 34B which telescope within each other.

At the curbside end, the outer most portion of the boom 14C has connected thereto a hydraulic rotary actuator 49. Typically, this is a helical rotary actuator such as manufactured by the Helac Corporation, H-Series. Hydraulic power, not shown, is supplied to the rotary actuators at 52 and 54. The rotary actuator 49 includes a U-shaped flange 56 to which the mast, generally designated by the numeral 18, is attached to forward plate 60. Attachment fasteners 62 connect the flange to the rotary actuator 49. Application of hydraulic pressure to the rotary actuator 49 will cause the bottom end of the mast to pivot inwardly and outwardly as needed during the operation.

Referring to FIG. 5, a side view of the extensible boom 14 is shown including the support bushings 66 and 68 which support that portion of the extensible boom 14B while extensible boom 14C is supported by bushing 70. These self-lubricating bushings are of any suitable material including material such as sold under the trademark NYLATRON®.

Figure 6:
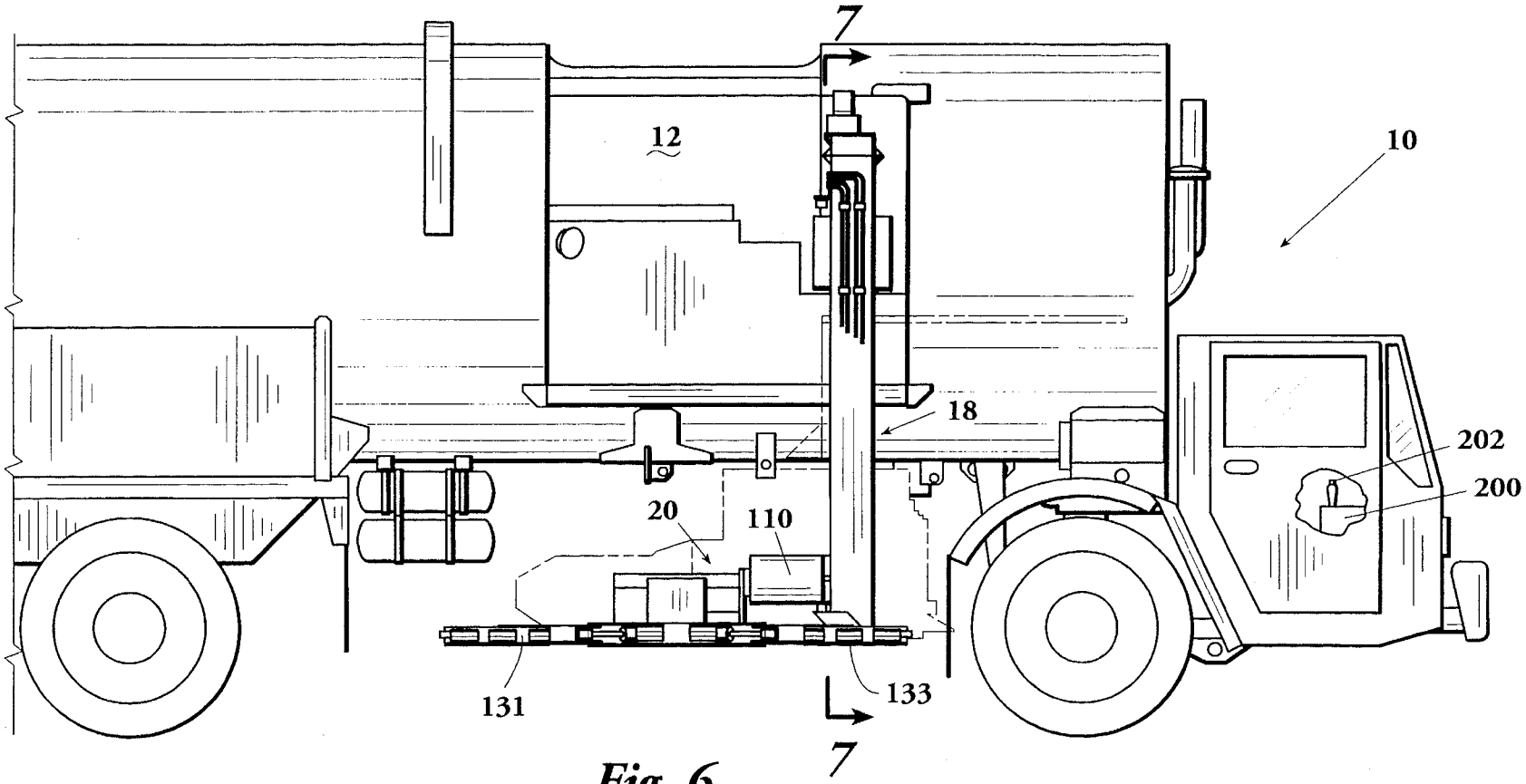
FIG. 6 is a side elevational view of the side loader of this invention as it is attached to the vehicle.

FIG. 6 is a right side view of the apparatus of this invention as it is installed on the vehicle 10 depicting the mast 18 and grabber assembly 20 from a curbside view.

FIG. 7 depicts the mast 18 when viewing forwardly. The apparatus includes an outer housing 72 which is attached by way of flange plate 60 to the rotary actuator 49 shown in FIGS. 4 and 5. The gusset plate 74 is adapted to receive the flexible extension 16 which carries the electrical/hydraulic/pneumatic power conduits to the mast assembly 18 and grabber assembly 20. Internally within the mast is a recirculating ball screw 76 along its entire length and supported by thrust bearing 80 at the top and a radial bearing 82 at the bottom of the mast. The ball screw 76 is driven by hydraulic motor 86 which is interconnected to a brake 88 which operates to prevent rotation of the ball screw when the hydraulic power to the motor 86 is turned off. The grabber arm assembly 20 is attached to the carriage assembly, generally designated by the numeral 90, which is described in greater detail in FIG. 8.

Figure 8:
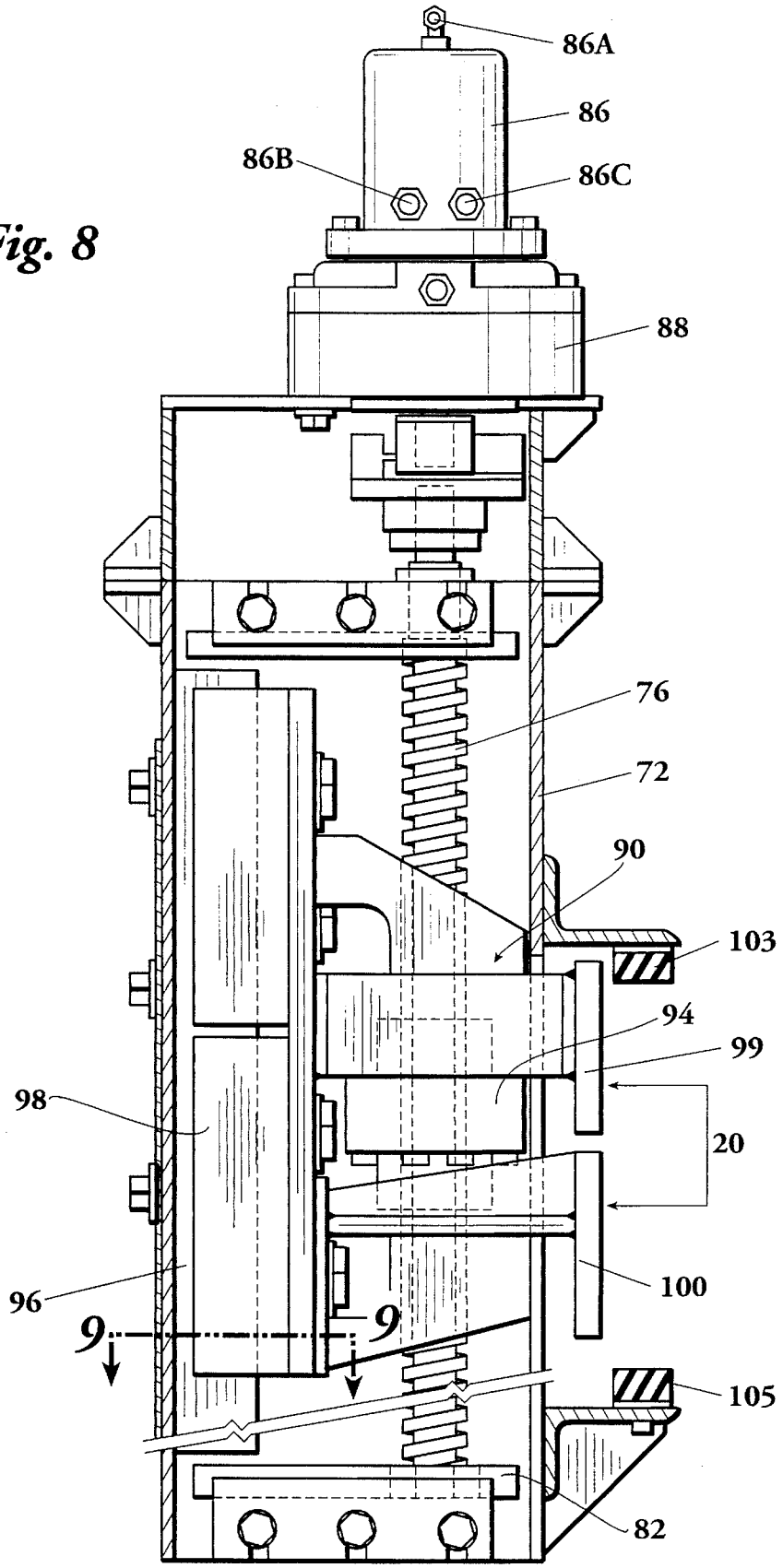
FIG. 8 is a sectional view of the mast operating system.

Referring to FIGS. 8 and 9, the grabber assembly carriage 90 is adapted to ascend and descend by the rotation of shaft 76. The carriage 90 is essentially a part of nut assembly 94 on the ball screw 76, so that in operation the carriage assembly 90 will traverse upwardly and downwardly as the ball screw 76 is rotated by hydraulic motor 86 during the operation of the side loader.

As shown in FIGS. 8 and 9, the carriage is supported so as to prevent any radial loads upon the screw and nut by utilizing a linear guide rail 96 and linear guide bearings 98 of a recirculating ball type such as Star BALL RAIL® systems which is attached to the mast housing 72. Accordingly, all of the load will be a vertical load upon the ball screw 76 via nut 94.

Figure 10:
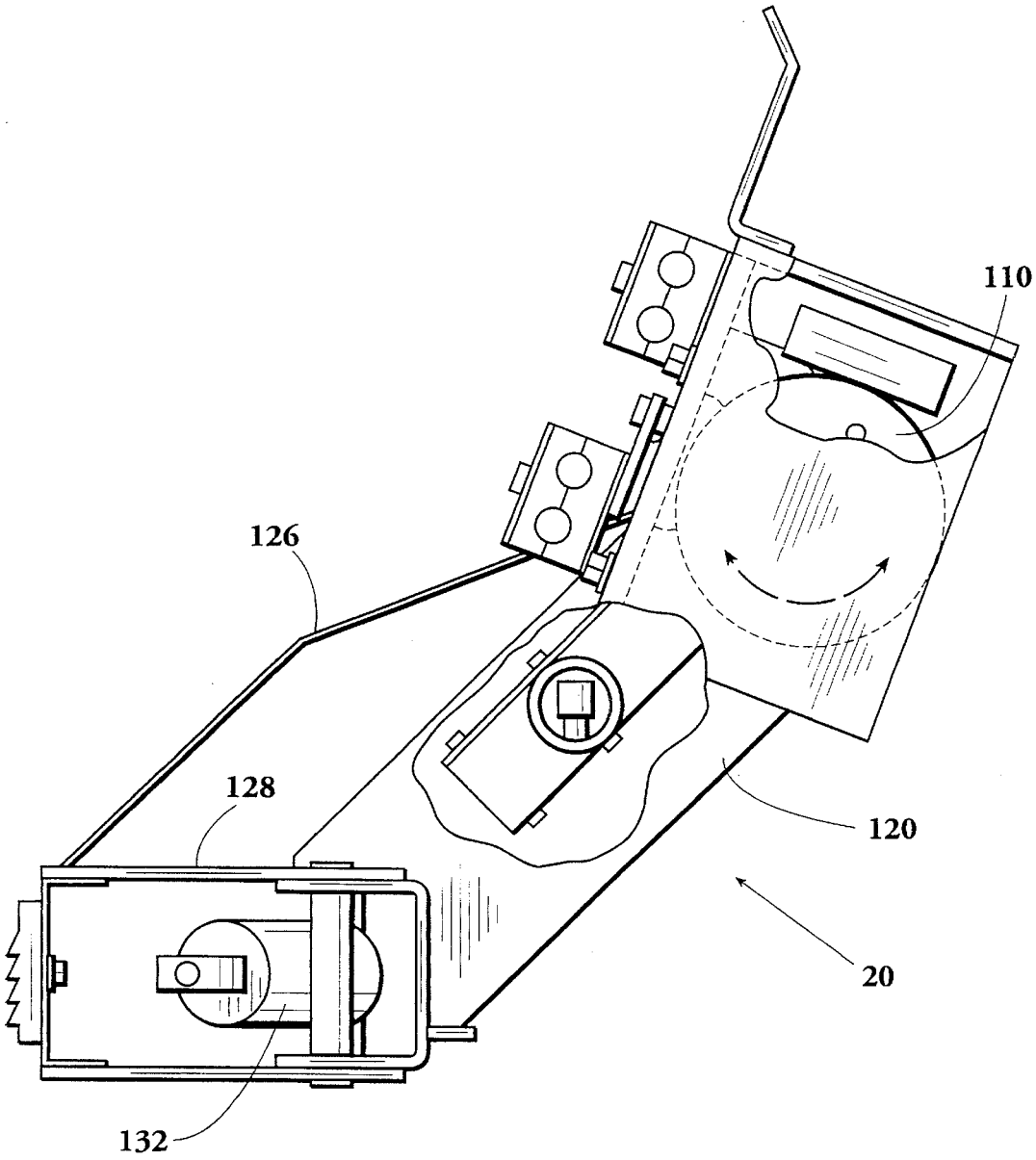
FIG. 10 is a side elevational view, partly cut away, of the grabber arm assembly looking rearwardly.
Figure 11:
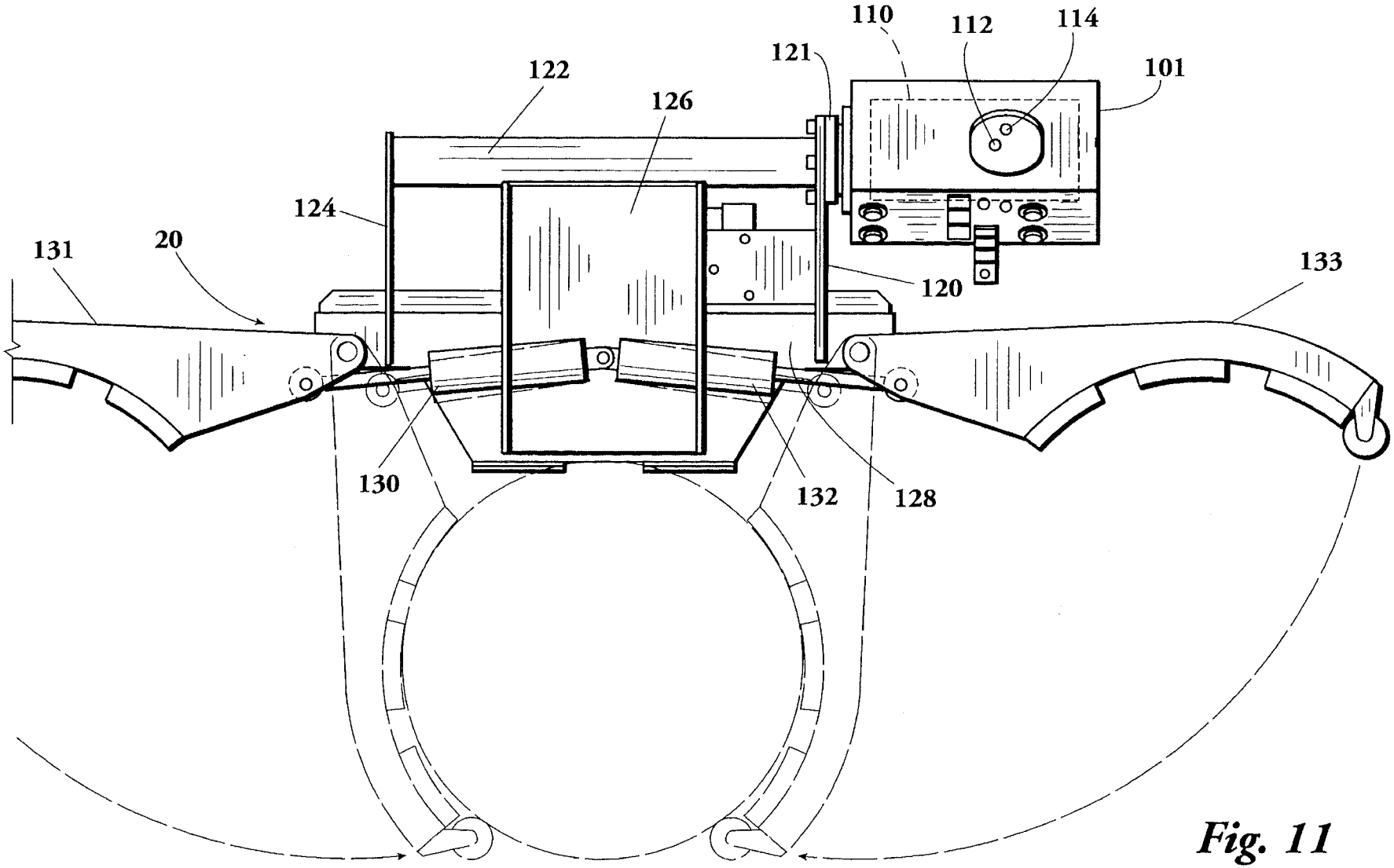
FIG. 11 is a top elevational view of the grabber arm assembly.

Referring now to FIGS. 10 and 11, the grabber assembly 20 is depicted in a side view and top view respectfully. As shown in FIGS. 7 and 8, the carriage and nut assembly 90 and 94 includes flanged attachments 99 and 100 to receive a manufactured bracket 101 for the hydraulic rotary actuator 110 which is substantially the same type of actuator 49 heretofore described as a part of the mast/extensible boom connection. Appropriate hydraulic connections 112 and 114 are connected to suitable hydraulic power source, not shown, via conduits from the vehicle. The grabber assembly 20 is connected to the rotary actuator 110 by way of mounting flange 120 on 20 and output flange 121 on 110. Hydraulic power cylinders 130 and 132 are connected to the grabber arms so as to oscillate them inwardly and outwardly as in a well known manner to grasp and release the trash containers as shown in these views. The hydraulic rotary actuator 110 is adapted to rotate the grabber assembly for the various positions during the operation and/or stowed position during the highway travel of the vehicle as shown in FIG. 3.

Figure 12:
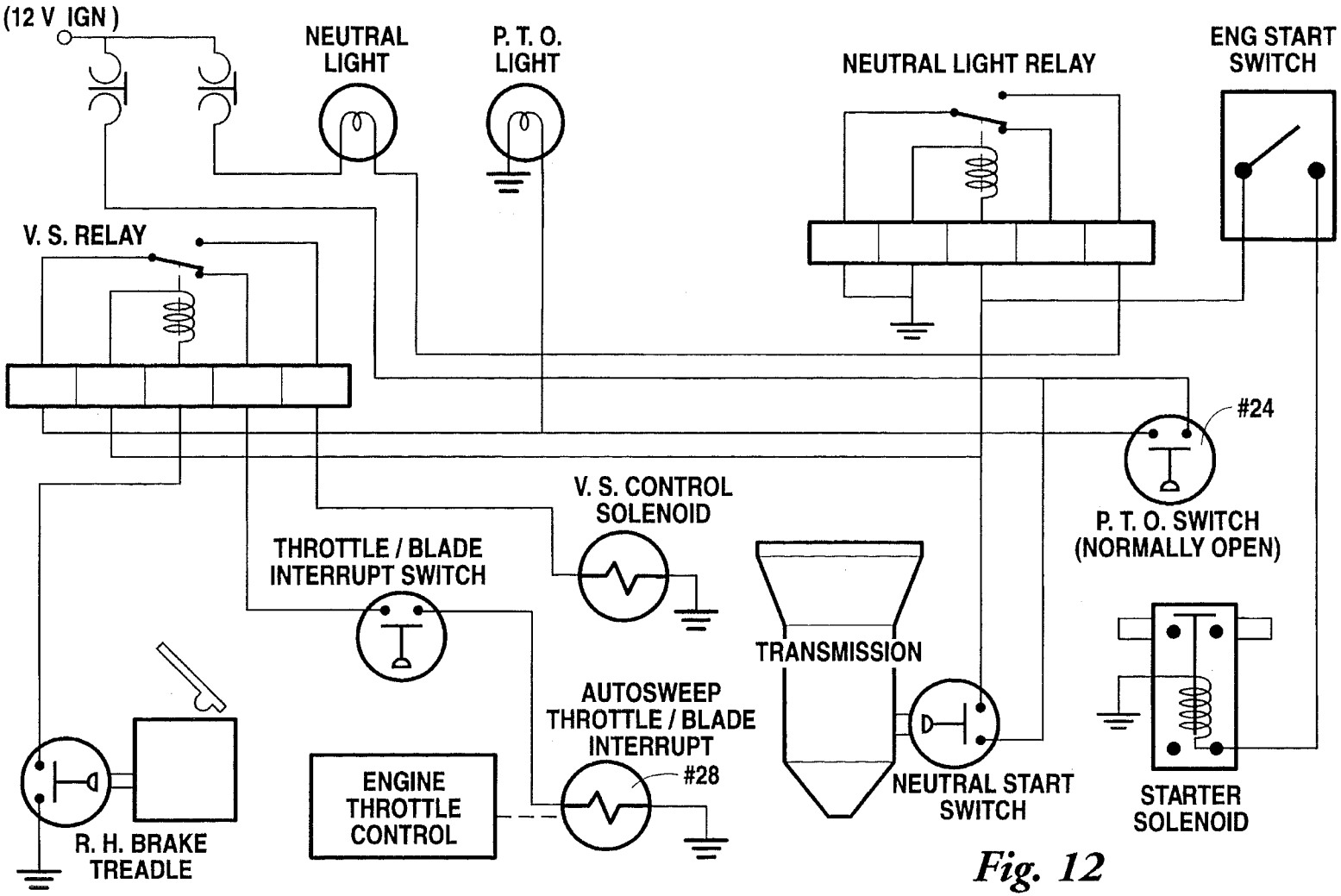
FIG. 12 is an electrical schematic of the engine variable speed control system.

FIG. 12 depicts the components and schematic electrical wiring diagram pertaining to the variable speed engine control feature of Applicant's invention. A variable speed (V.S.) control is required to allow the driver/operator greater flexibility when operating the vehicles hydraulic systems, i.e., compactor piston in its auto sweep and manual sweep, or the lift boom/mast/carriage functions. The term "auto sweep" refers to the continuous reciprocating movement of a trash compactor piston within the vehicle compressing the collected trash to the rear of the vehicle. A "manual sweep" refers to operator controlled movement of the piston. One of the useful function of this system is during the refuse pick-up, lift, dump sequencing, is where the operator, merely by stepping on the brake at a pick-up location, will engage the V.S. control which will limit the maximum engine r.p.m. to prevent overspeeding of the hydraulic pump system. Engagement of the V.S. mode requires:

1) The P.T.O. is "on";

2) The brake treadle depressed; and

3) The transmission be in neutral.

Having the transmission in neutral, forces the operator to use the brake and prevents the driver from overspeeding or torque stalling the transmission with ensuing build-up of destructive heat.

Figure 13A:
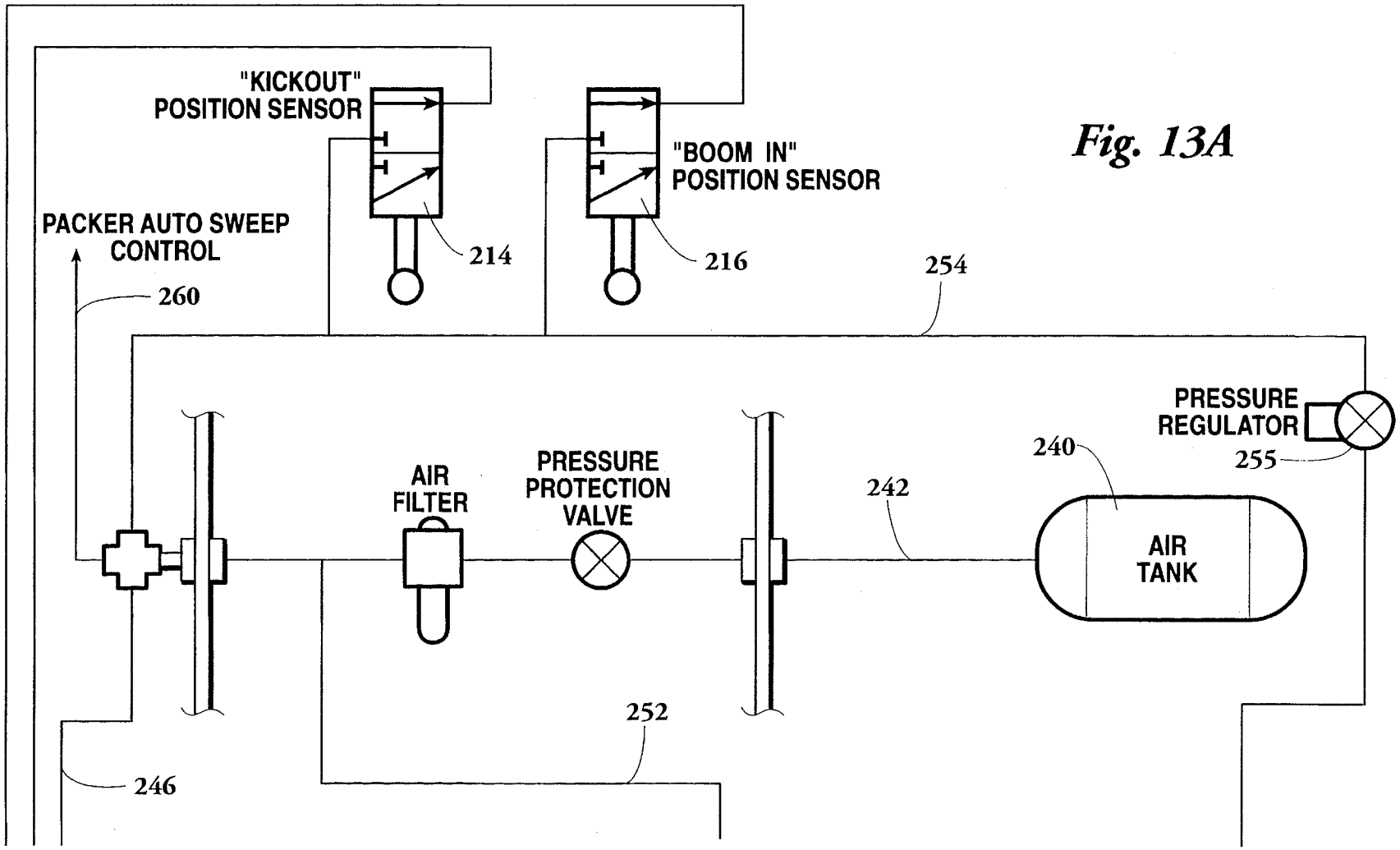
FIGS. 13 A, B and C are schematics of the pneumatic sequencing controls.
Figure 13B:
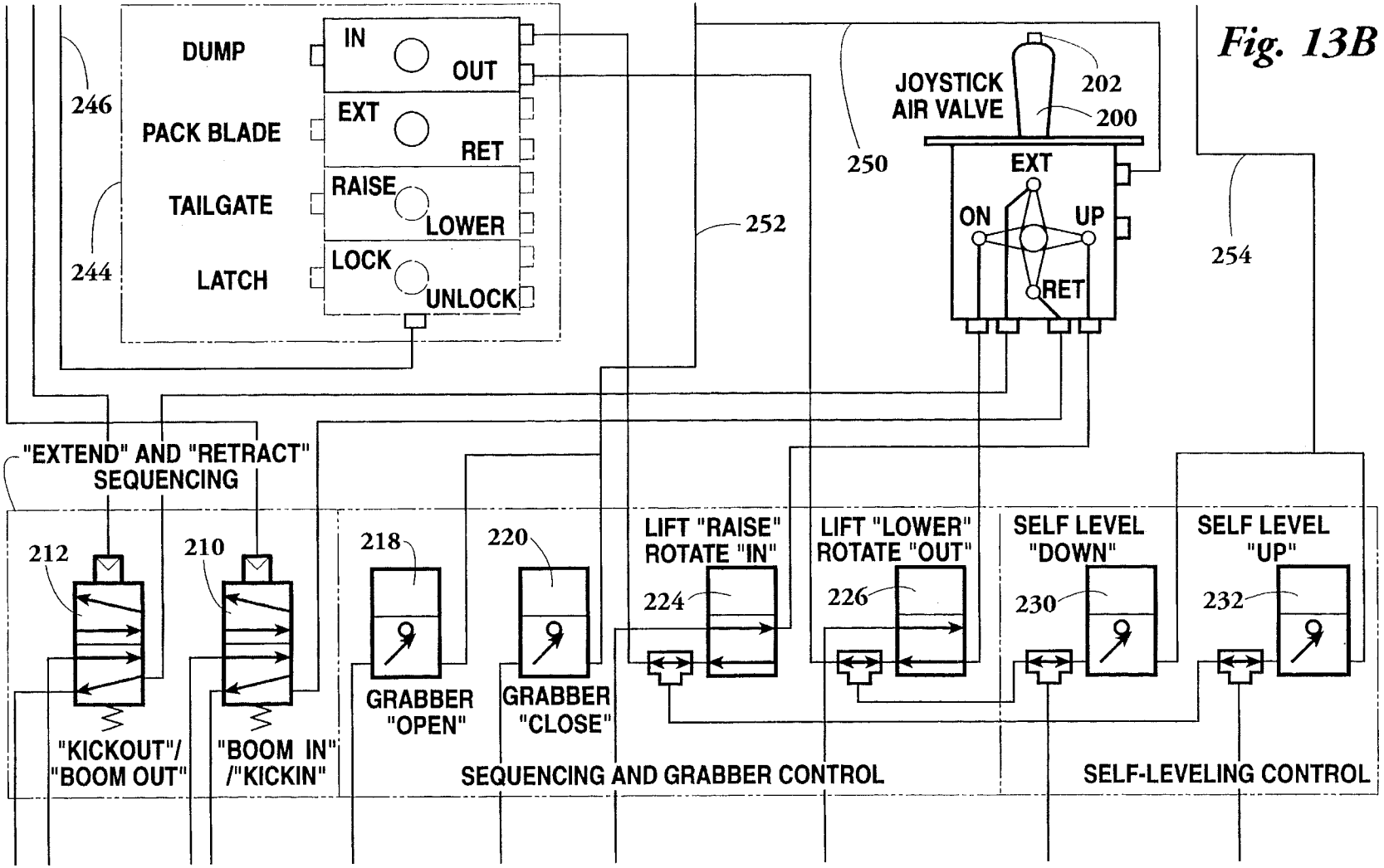
Figure 13C:
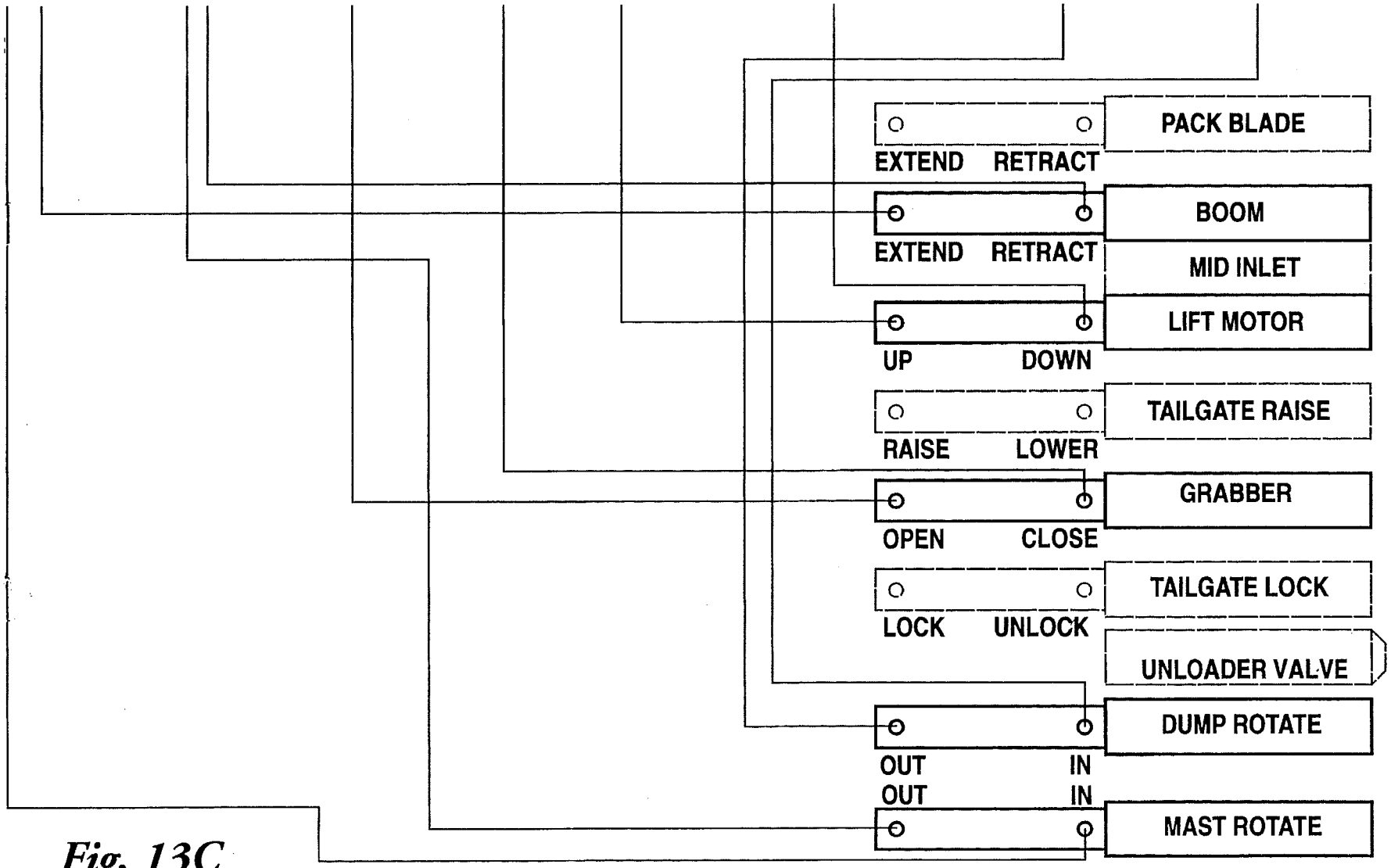

Referring now to FIGS. 13 A, B and C, the system utilizes a four-way, three-position, aircraft type control lever or "joy stick" type actuated proportional pneumatic valve 200 for manual control of the electric/pneumatic/hydraulic functions by the operator. FIGS. 13A and 13B represent a schematic diagram of the air over hydraulic functions of the lift sequencing wherein mechanical rotary actuated pneumatic limit switches sense the position of the mast rotation (kick-in or kick-out) and boom end position (retracted or extended).

The joy stick control 200 is adapted to actuate the various functions herein described by pneumatic actuators which in turn operate associated hydraulic valve spools to the various parts of the system. As shown in FIGS. 13A and B, the in and out position of boom 14 is controlled by pneumatic valves 210, 212 and 214 respectively. Pneumatic rotary actuators 214 and 216 actuate valves 210 and 212, being mounted on the mast and the actuator 216 being mounted on the boom. Solenoid valves 218 and 220 function to operate the grabber arms 131 and 133. The lift, raise and rotational motion of the grabber arms to dump the refuse container is controlled by solenoid valve 224. Valve 226 functions to reverse rotate the grabber arms and lower grabber arms and refuse container to the bottom of the mast 18. During the process of lift up and down to maintain, self-levelling occurs through the function of solenoid valves 230 and 232. In the event more curbside containers are to be picked up, the operator will drive the vehicle to the next position. In such event, it is not necessary to retract the mast except as needed where there are intervening objects, nor is it necessary to lift the carriage and grabber assembly to its stowed position. In some instances, the grabber assembly can be pivoted or rotated upward while in the lowered position. Air to the system is supplied by a compressor source 240 which is divided as shown via input line 242 to the manual operational control 244 by way of conduit 246. Another portion of the input air goes via conduit 250 to the controller 200 while another supply line 252 and 254, the latter via pressure regulator 255, go to operate various functions as shown in FIGS. 14A and B. Conduit 260 carries air to a packer blade autosweep control system, not shown.

All the necessary lift functions can be performed with the proportional joy stick controller 200 without the operator having to leave his or her position. The controller 200 is preferably located on the inside of the right side door as shown in FIG. 6. Typical operation begins with the grabbers 20 closed and stored in the hopper area 12. Once the vehicle has been started, an engine driven power take-off provides operation of the hydraulic pump system. Once the vehicle has reached the pick-up location, the self-levelling system is turned on. The purpose of the self-levelling is to maintain the grabber arms assembly 20 substantially level during the pick-up, lift, raise and lower operations, it being deactivated during the dump in-and-out procedures. The joy stick 200 provides proportional pneumatic controls that can be varied by the amount of the joy stick displacement. Pushing the joy stick forward, rotates the grabber 20 from its stored position to a position normal to the mast 18. At this point, the next function is sequenced by electrical limit switch attached to the hydraulic actuator mounting bracket 101 and mechanically actuated by the movement of the grabber assembly 20. Maintaining the joy stick forward will operate the hydraulic motor 86, and the grabber assembly 20 will then descend from the top of the mast 18 while maintaining the grabbers 20 at a level attitude no matter the angular position of the mast 18. The grabber assembly 20 descends to the bottom of the mast 18 and stops on a cushioned mechanical stop 105 similar to one 103 located at the top of the mast 18.

A three position thumb actuated rocker switch 202 located on the top of the joy stick 200 is used to control the grabber arms, i.e., on-off-on. The 202 switch is depressed to "open" the grabber arms and held until they are fully open.

Mast 18 is pivotally extended by the controller/joy stick 200 by movement to the right (toward curbside). This pivotal movement or 'kick-out' occurs by the rotary motion of the hydraulic rotary actuator 49. This motion may be stopped at any point by returning the joy stick 200 to the center/neutral position. The joy stick 200 is biased so as to return to the center position to stop the operation any time when released. Once the mast 18 reaches its maximum pivotal displacement of 20°, a pneumatic limit switch 214 is tripped. Maintaining the joy stick to the right (curbside) will sequence the boom "extend" function.

Once the desired lift extension has been reached, the joy stick is returned to the neutral position.

Using the thumb of the hand on the joy stick, the grabber "close" switch 202 is depressed and held until the refuse container 22 has been restrained by the grabber arms 20. The hydraulic circuits controlling the grabber have adjustable work port relief pressure settings to control the clamping and opening force of the grabber arms and prevent damaging the container or the grabber arms 20. The lift is now in position ready to retrieve curbside containers 22.

Pushing the joy stick to the left causes the boom to "retract", if required, followed by the mast "kick in", if required. The boom 14 retraction maybe stopped at any point by returning the joy stick to the center position. Pulling the joy stick back causes the carriage assembly 90, having the grabber 20 and the now clamped refuse container 22 to raise. When they reach the top of the mast, there is a cushioned bump stop 103 and actuation of an electrical limit switch, the lift motor is then sequenced off and the dump "in" function begins. When this occurs, the auto-levelling system is temporarily disabled. In the event the refuse is stubborn to exit the refuse container 22, the operator has the capability to manually "shake" the container by using the manual dump "out" and dump "in" lever 244 or rocking the joy stick 200 lever back and forth. Subsequently, the container is rotated out, lowered, the boom is extended to the position where the refuse container was previously located and the grabbers are opened releasing the container retract system. When finished, the boom is then retracted, the grabbers positioned in the closed position and raised to the travelling position as previously described in FIG. 3. This sequence of events occurs as the vehicle moves down the street from one curbside refuse container location to another.

One of the key features of the side loading refuse vehicle is its ability to operate, i.e., conduct curbside pick-up with the mast retracted, fully extended, or partially extended, depending upon the location of the refuse container. This allows the operation to proceed in those instances where the container may be located between parked curbside vehicles, trees or other obstructions that would normally prevent the vehicle from getting closer to the curb.

What is claimed is:

1. A side loader for a refuse vehicle for engaging, retracting and dumping a curbside refuse container into a top open refuse compartment in said vehicle and returning and disengaging said refuse container to said curbside, said loader comprising:

a telescopic boom supported at one end within said top opening of said refuse compartment, an outer end of said telescopic boom being extensible transverse to said vehicle;

a mast pivotally connected, adjacent its upper end, to said outer end of said support boom for movement within a vertical plane, said mast having a rotatable threaded shaft along its length; a carriage assembly retained within said mast and threadably connected to said shaft whereby rotation of said shaft will cause said carriage assembly to travel along said mast from said upper end to a lower end, said pivotal connection comprising a first motor having a rotatable means connected to said mast;

a grabber arm assembly pivotally attached to said carriage assembly via a second motor having a rotatable means connected to said grabber arm assembly, said grabber arm assembly including pivotal arms for grasping and releasing said refuse container;

means to operate said second motor to maintain said refuse container pivotal arms substantially horizontal no matter what angular position of said mast as it travels along said mast;

means to actuate said pivotal arms to grasp said container;

means to rotate said threaded shaft whereby said grabber arm assembly will travel upward and downward along said mast;

means to operate said second motor whereby said grabber arm assembly is sequentially caused to pivot said refuse container at a top of said mast to dump refuse into said refuse compartment.

2. A side loader according to claim 1 wherein said first and second motors comprise hydraulic actuated helical rotary actuators.

3. A side loader according the claim 2 wherein threads of said threaded shaft are acme.

4. A side loader according to claim 1 including a brake normally preventing rotation of said threaded shaft, means to release said brake when said means to rotate said threaded shaft is operative.

5. A side loader according the claim 4 wherein threads of said threaded shaft are acme.

6. A side loader according the claim 1 wherein threads of said threaded shaft are acme.

* * * * *